United States Patent [19]

Messa

[11] 4,105,228

[45] Aug. 8, 1978

[54] AUTOMATIC KNOT-FORMING MACHINE FOR THE FORMATION OF THE FISHERMAN'S KNOT

[75] Inventor: Pietro Messa, Salo' (Brescia), Italy

[73] Assignee: Mesdan S.p.A, Salo' (Brescia), Italy

[21] Appl. No.: 847,487

[22] Filed: Nov. 1, 1977

[30] Foreign Application Priority Data

Nov. 3, 1976 [IT] Italy ..... 29017 A/76

[51] Int. Cl.[2] ..... A01D 59/04

[52] U.S. Cl. ..... 289/2

[58] Field of Search ..... 289/2

[56] References Cited

U.S. PATENT DOCUMENTS 3,734,285 5/1973 Messa ..... 289/2

3,838,874 10/1974 Messa ..... 289/2

3,861,725 1/1975 Messa ..... 289/2

*Primary Examiner*—Louis K. Rimrodt

*Attorney, Agent, or Firm*—Haseltine, Lake & Waters

[57] ABSTRACT

In a knot-forming machine of the kind adapted to form the so-called fisherman's knot, the improvement is disclosed which consists in that the extraction member is oscillable between the usual rotary hooks, the top position of the extractor member being adjustable. An upward open throat and a transversal arm having two upward open throats are also provided, which cooperate with two cam-actuated control rods: the connection between either control rod and the respective cam follower is fixed, whereas the other connection is adjustable. The arrangement disclosed herein is especially adapted for using the machine in making knots with large-count yarns.

4 Claims, 14 Drawing Figures

AUTOMATIC KNOT-FORMING MACHINE FOR THE FORMATION OF THE FISHERMAN'S KNOT

This invention relates to an automatic knot-forming machine for the formation of the fisherman's knot, especially for yarns of large thickness.

Automatic knot-forming machines for the formation of the fisherman's knot are well known in the art. They are commonly adopted on the spoolers for the knotting of the threads to be spooled.

A type of knot-forming machine of the kind referred hereinabove is disclosed and illustrated in the U.S. Pat. No. 3,861,725, which is the property of the same Applicant Company hereof. This patent clearly shows the several component parts of the knot-forming machine and their operability during the knot-forming operation.

In all the known-knot-forming machines of this kind, including the one according to the U.S. Patent aforementioned, the principal members which coact in the formation of the fisherman's knot (which, as is well known, is composed by two individual knots titghened together) substantially comprise thread-latching members, thread crossing members and tensioning members, as well as rotary hooks fitted with scissors for cutting and holding the thread tails.

The wide variety of types of yarns to be treated has always involved a number of problems and has demanded the provision of several kinds of knot-forming machines, even if, recently, it has been tried, by appropriate improvements, considerably to improve the knotting capacity of such machines.

This notwithstanding, there are, still now, several kinds of yarns which have not even taken into consideration hitherto for the automatic knot-formation in view of the difficulty of forming with them, in a practical and reliable manner, the fisherman's knot.

These are, more particularly, yarns having a large count, such as for example having a metric count (Nm) from 5, or even more, from 2.5 onwards. These large yarns lend themselves very poorly to the formation of a fisherman's knot composed by two individual knots, so that such yarns have been practically excluded hitherto from the automatic knot-forming.

As a matter of fact, whenever it is desired to form the fisherman's knot with such large-count yarns a number of problems are encountered.

Thus, it has been ascertained that a difficult operation is that of the formation of the individual knots by the agency of the rotary hooks, and precisely that of winding the crossed wires around the shanks of said hooks.

Another extremely critical stage is, then, the one of the slipping or withdrawal of the individual knots from the respective hooks, since such slipping operation must take place within a field of rotation of the hooks which is rather narrow, that is, when the hooks themselves, during their rotation, take angular positions comprised within a certain angular field.

In addition, a particular importance is taken by the correct and maximum tensioning of the as-made knot for latching the two elementary knots together. Such a tensioning step must be variable according to the count of the yarn to be knotted and the nature of the yarn itself.

All of the problems enumerated above, to which other minor problems are to be added which will be illustrated hereinafter, make up, as a whole, the technical problem that the present invention aims to solving.

A purpose of the invention is thus that of providing an automatic knot-forming machine capable of forming the fisherman's knot even with very coarse yarns having a count of yarn (metric) in the order of magnitude aforementioned.

To attain this purpose, it has been seen, in the first place, that it is necessary to adopt an extracting member known per se especially in the hand-operated knot-forming machines, which member, in addition to providing to withdraw and to tension the knots, must also have the task of cooperating with the thread-crossing members to the formation of the knot as such.

It is, thus, a purpose of the present invention a knot-forming machine of automatic type for the formation of the fisherman's knot, especially for coarse yarns and intended to be installed on an automatic spooler, comprising members for latching the threads to be knotted, thread-crossing devices, confrontingly mounted rotary hooks equipped with scissors for severing and holding the thread tails and an extracting and tensioning member for the knot, said latching members, crossing members and extracting member being driven by cams mounted on a control shaft, the machine being characterized in that the extracting member arranged oscillably between the two hooks which rotate on a midway plane vertical between a lowered at rest position and an adjustable top position is formed by a flat lever fulcrumed at an intermediate point and fitted in the vicinity of one end of a throat open towards the top and with a transversal arm with two additional throats open towards the top in correspondence with the ends of said arm, at the opposite end of said lever there being fulcrumed on a common pivot two control rods actuated by intermediate levers by two distinct cams mounted on the control shaft, the connection between one of these rods and the relative lever being fixed, whereas the connection between the other rod and its lever is adjustable, said cams being intended to control in two sequential stages the lifting of the extracting member from the at rest position to the raised position.

By virtue of the extracting member and its special control as defined above, there have been solved the problems of the automatic formation of knots of even very coarse yarns.

The structural and functional features of the automatic knot-forming machine according to the present invention will become clearer from the following description of a preferred embodiment of this invention given by way of example only with reference to the accompanying drawings, wherein.

Figure 6:
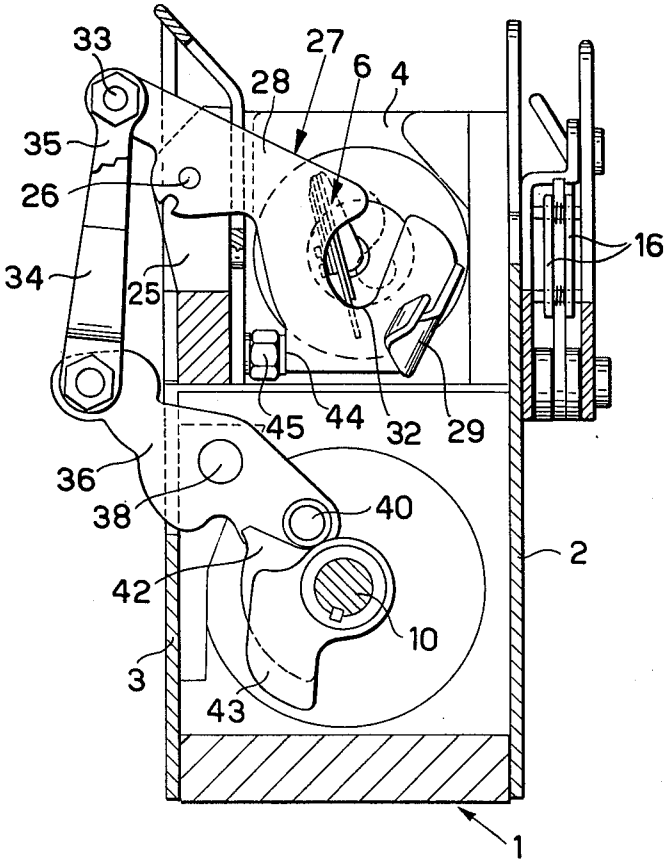
FIG. 6 is a vertical cross-sectional view taken along the line VI—VI of FIG. 4, clearly showing the position of the extracting member in its working position.

FIGS. from 7 to 9 are views of the extracting members with its relative control means, similar to the view of FIG. 6, but in sequential working stages, and FIGS. from 10 to 14 diagrammatically show the knot-forming machine in plan view in the subsequent working stages for the formation of the fisherman's knot.

Of the knot-forming machine there will be described in the following only those parts which are essential for understanding the invention and the operation of the machine, whereas it is understood that all the remaining component parts which are not specifically mentioned are conformant, as to their structure and operation, to the known art.

The machine comprises a casing 1 closed on the left side by a plate 2 and on the right side by a plate 3. To the casing 1 are affixed two supporting members 4 and 5, respectively, for the front rotary hook 6 and for the rear rotary hook 7.

The bearings 8 and 9 of the casing 1 support for rotation a horizontal shaft 10 which, at the outside of the casing, carries a member 11 which is adapted to receive a rotary motion by a drive (not shown) of the spooler to which the knot-forming machine is intended to be connected.

The shaft 10 controls, through gearings not shown, in a conventional fashion, the rotation of the rotary hooks 6, 7 with a gear ratio of 1:2, so that a complete revolution of the shaft 10 (corresponding to an entire knot-making cycle) corresponds to two revolutions of the rotary hooks.

Figure 5:
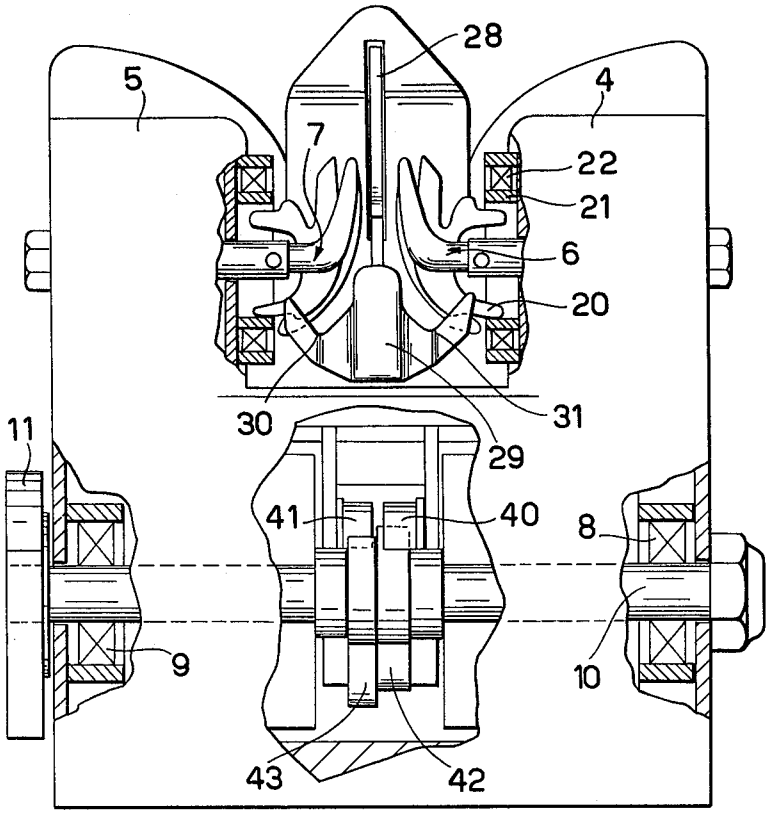
FIG. 5 is a view, partly in cross-section, vertically along the line V—V of FIG. 1.

Each of these hooks comprises, in a known manner, a scissors composed by at least a fixed portion and at least an oscillating portion, this latter being driven to swing by the engagement of a tail portion of its, 20, with an eccentric ring 21, mounted for rotation, through a strong ball bearing 22 or the like, in the respective supporting member 4 or 5 (best seen in FIG. 5).

It is to be noted that it has proven an advantage to mount rotatably said eccentric rings for controlling the scissors associated with the rotary hooks because the forces required for cutting and holding the tails of the coarse yarns the machine must knot together are considerable. By virtue of mounting such rings with ball bearings or like members, the friction is reduced between the tail of the oscillating portion of the scissors and the same eccentric control rings.

Figure 2:
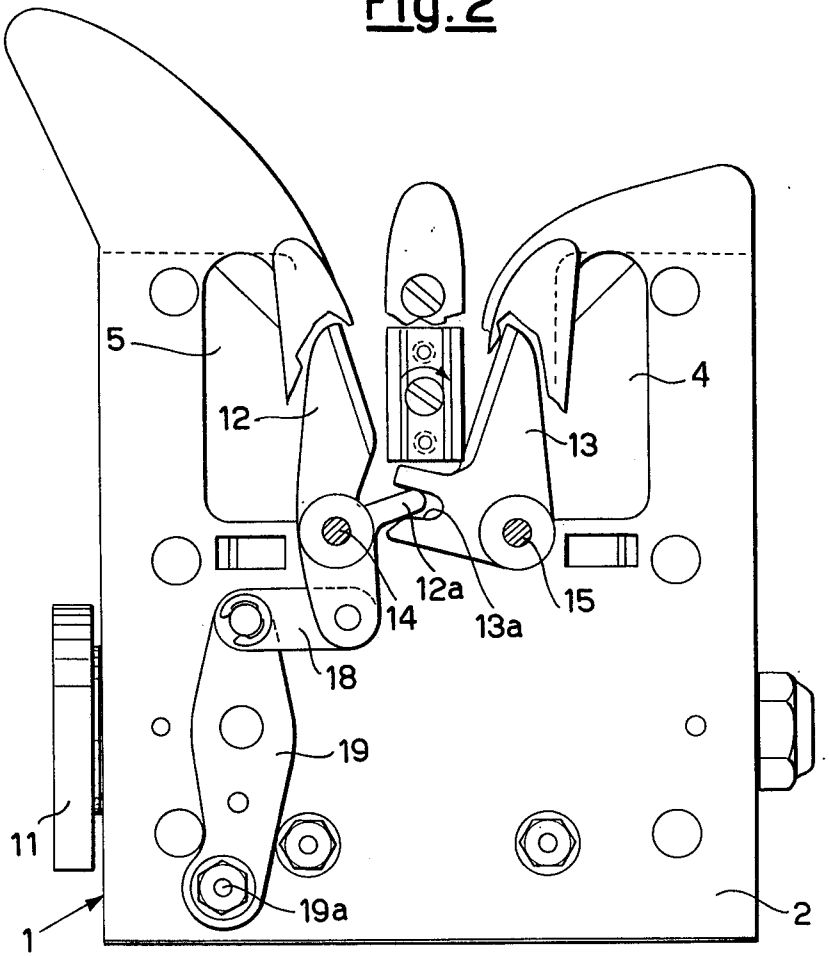
FIG. 2 shows the machine as viewed from the left.

The machine also comprises, mounted on the outside of its wall 2 of the left sidewall, members 12, 13, fulcrumed at 14 and 15, respectively, and cooperating with pairs of springs 16, 17 to latch the yarns to be knotted together. The members 12 and 13 are interconnected by a tongue **12*a* which projects from the member 12 and which enters into a notch, 13*a* of the member 13 (see FIG. 2) and the member 12 is actuated by a leverage 18, 19, the latter being driven by a cam (not shown in the drawings) keyed to the shaft 10. When the lever 19 is oscillated in the counterclockwise direction (as viewed in FIG. 2) about its pivot 19*a*, the member 12 oscillates in clockwise direction about its pivot 14 and enters between the two springs 16, while it simultaneously causes an oscillation of the member 13 anticlockwise about the pivot 15 thereof and the penetration of 13 between the springs 17**.

Figure 4:
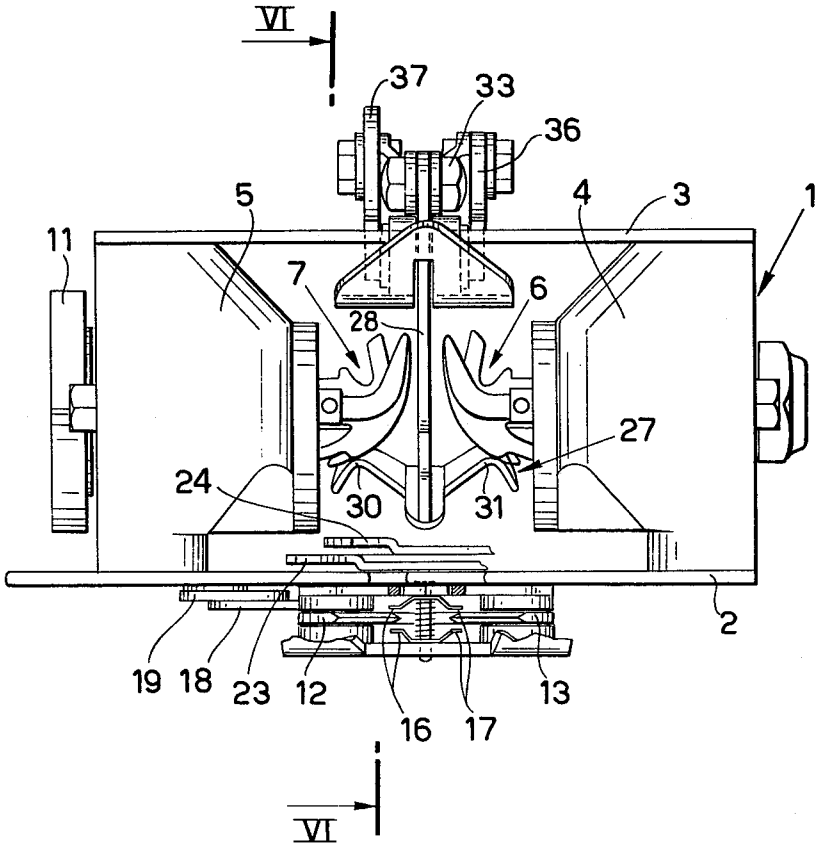
FIG. 4 is a plan view of the machine.

The machine has also thread-crossing members 23, 24 (see FIG. 4 and FIGS. from 10 to 14) which are driven in the conventional manner (not shown) by specially provided cams keyed to the control shaft 10 and adapted to act with their free ends, shaped as hooks, on the yarns to be knotted together.

Figure 3:
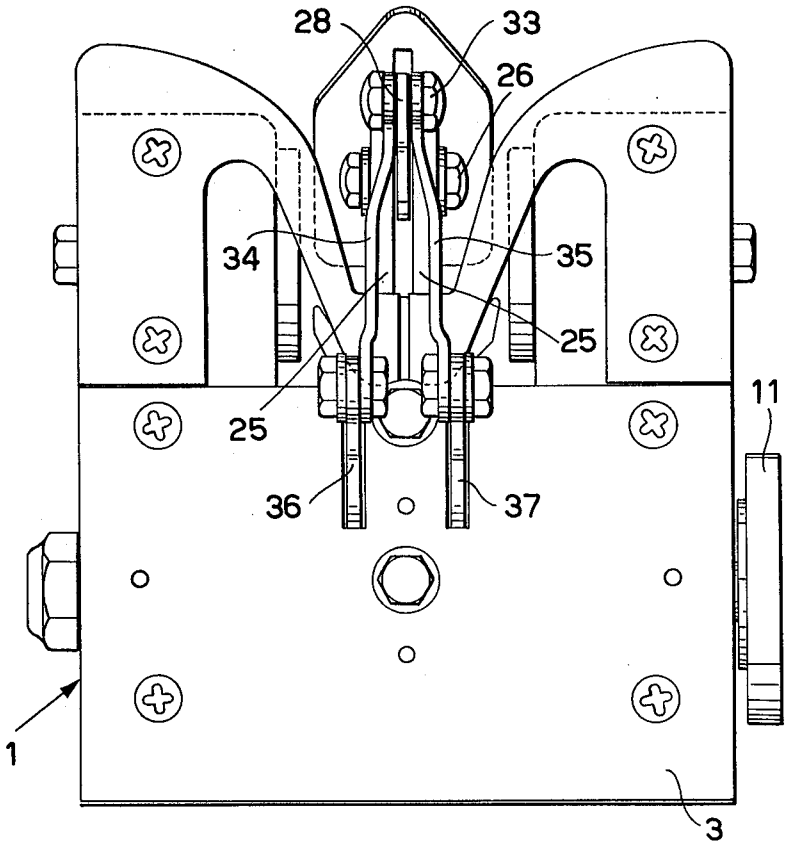
FIG. 3 shows the machine as viewed from the right.

In a fixed supporting member 25 integral with the casing 1 (see FIGS. 3 and 6) is mounted rotatably about a horizontal pin 26, the extractor member, generally indicated at 27. The member 27 is composed by a shaped flat lever 28 (see FIGS. from 6 to 9) carrying at one end a shaped transversal arm 29 which has at its two respective ends two throats 30 and 31, open upwards. In addition, the lever 28 has, near the same end which carries the arm 29, a shaped throat 32 open upwards. This throat 32 can have various shapes and depths, as shown in FIGS. from 6 to 9 in solid lines and in dotted lines.

A throat 32 which is wider and deeper originates shorter ends of the knotted threads, whereas a smaller throat originates longer ends.

At the opposite end the flat lever 28 carries a pin 33 which is a common pivotal point for two control rods 34, 35. These rods are connected at the other side to respective levers 36, 37 which can be oscillated about intermediate pins 38, 39 and are fitted at their free ends with followers 40, 41 kept into contact with respective cams 42, 43: these are mounted the one on the side of the other on the shaft 10. A spring (not shown) tends to hold the followers 40, 41 to contact the respective cams 42, 43 and in the angular positions of the cams in which they do not interfere with the followers, the same spring maintains the extractor member 27 in a lowered at rest position (see FIG. 6) in which an edge 44 of 27 abuts against a fixed abutment 45.

Figure 9:
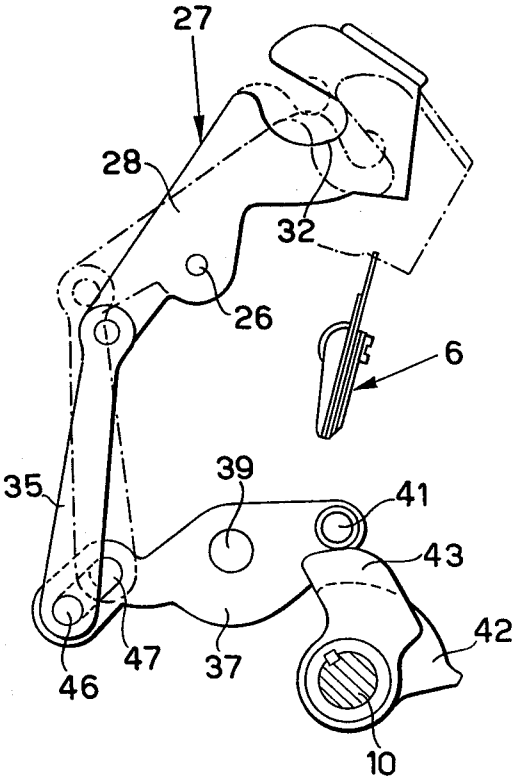

The extractor 27 can oscillate, therefore, on a midway vertical plane between the two rotary hooks 6, 7 between the lowered resting position indicated in FIG. 6 and a raised position indicated at FIG. 9. The maximum lift of the extractor 27 is adjustable by the agency of an adjustable connection between the rod 35 and the relative lever 37. As a matter of fact, as can clearly be seen in FIG. 9, the connection pin 46 of the lever 35 with the lever 37 can be displaced within a slot 47 formed through the end of said lever.

FIG. 9 shows in solid lines the position of maximum lift, and in dash-and-dot lines the position of minimum lift, of the extractor 27 at the end of the lifting stage commanded by the cam 43.

It should be observed that, characteristically according to this invention, the lifting of the extractor 27 from the at rest position (FIG. 6) to the raised position (FIG. 9) is commanded, in two sequential stages, firstly by the cam 42 through the lever 36 and the rod 34, and then by the cam 43 through the lever 37 and the rod 35. In the first lifting stage (from the position of FIG. 6 to that of FIG. 7), since the connection between the rod 34 and the lever 36 is fixed, the movement of the extractor is in a fixed relationship with the rotation of the hooks 6, 7, while the second lifting stage (FIGS. 7 to 8 to that of FIG. 9) can be brought from a minimum lift to a maximum lift due to the adjustable connection between the rod 35 and the lever 37.

Figure 7:
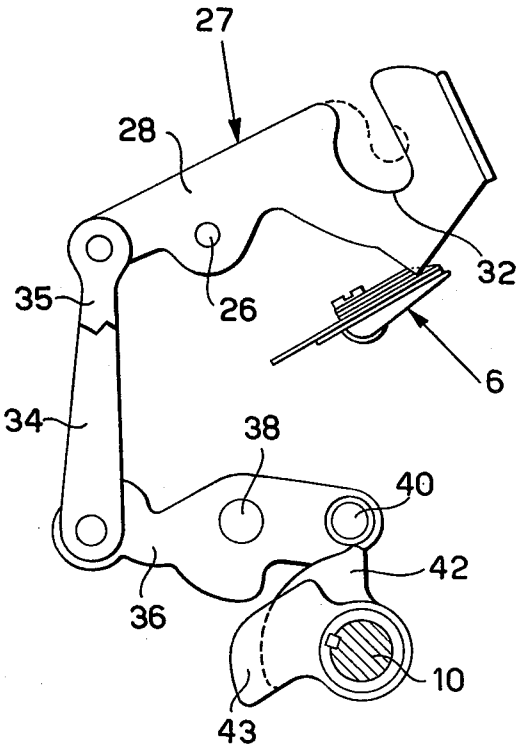

The first lifting stage of the extractor 27 serves, as will be appreciated hereinafter, to slip or to extract the individual knots from the rotary hooks 6, 7 and it is important that such a slipping operation takes place within a field of rotation of the hooks which is rather narrow in order to provide the condition which is the most favourable to such slipping (the position of the hook 6 indicated in FIG. 6 corresponds to the start, and the position indicated in FIG. 7 to the completion of the slipping stage).

The second lifting stage of the extractor 27 serves, conversely, to the union of the two individual knots and to the tensioning of the completed fisherman's knot and in this stage it is important to be able to adjust the maximum tensioning as permitted by the kind of yarn to be knotted. Thus a corresponding adjustabiliy is appropriate.

Inasmuch as the extractor must fulfil these different functions and requirements, it has been necessary to provide a double lifting control.

The machine is equipped, in addition, with the usual shaped guideways in the sidewalls for the correct positioning of the two yarns to be knotted. Lastly, a pincer can be provided, intended to retain the free ends of the two yarns without preventing their sliding in the knot-forming operation. These two latter portions of the machine are not described in detail since their function is well known.

The operation of the machine will now be briefly illustrated with particular reference to FIGS. from 10 to 14 which show several sequential stages of the operation for the formation of the fisherman's knot.

Figure 10:
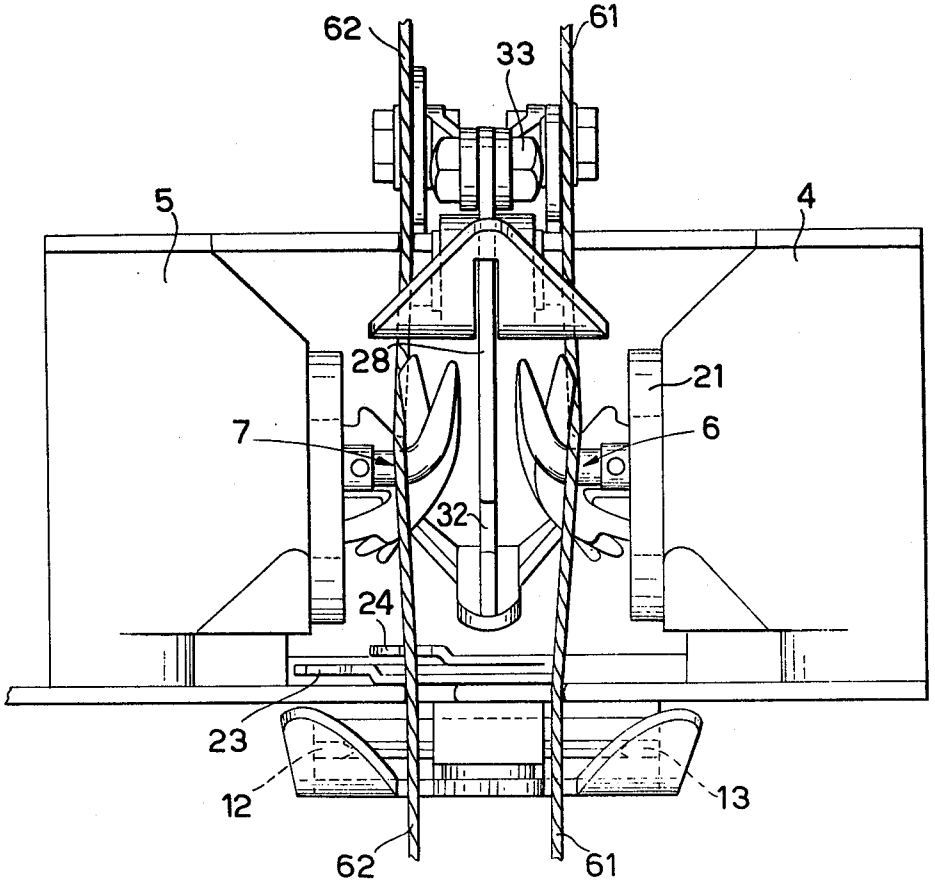

The two yarns to be knotted, 61 and 62, are introduced in the machine as shown in FIG. 10 so that their free ends are pointing towards the right side where they are held by the pincers (not shown) which, however, do not prevent their sliding. The yarns pass over the shanks of the rotary hooks 6, 7 so that they cannot be cut during the first revolution of the hooks.

Figure 1:
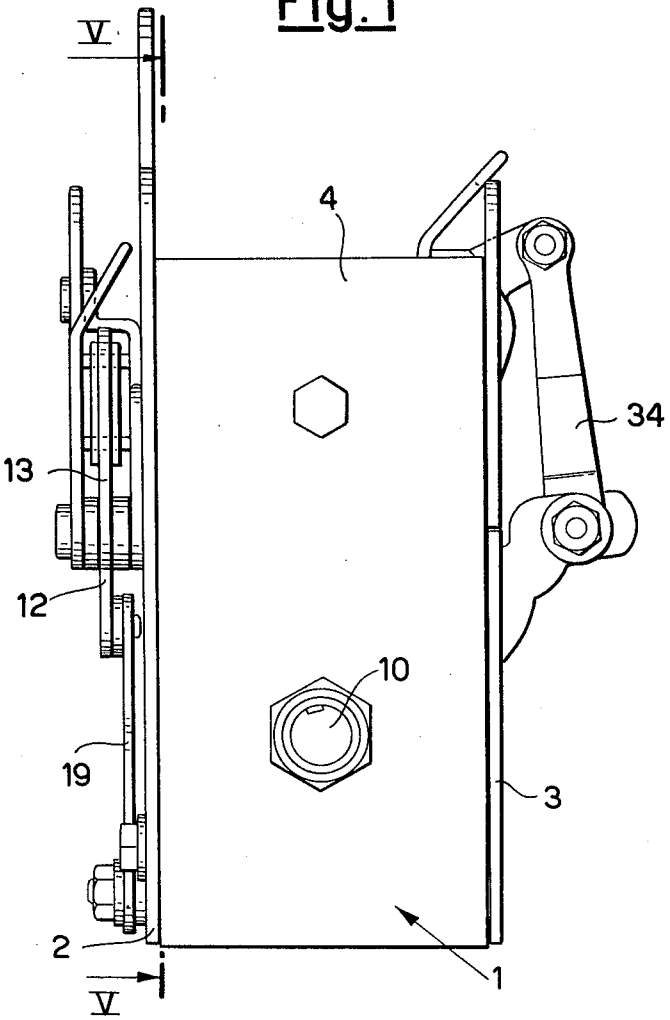
FIG. 1 shows the knot-forming machine in front view.
Figure 11:
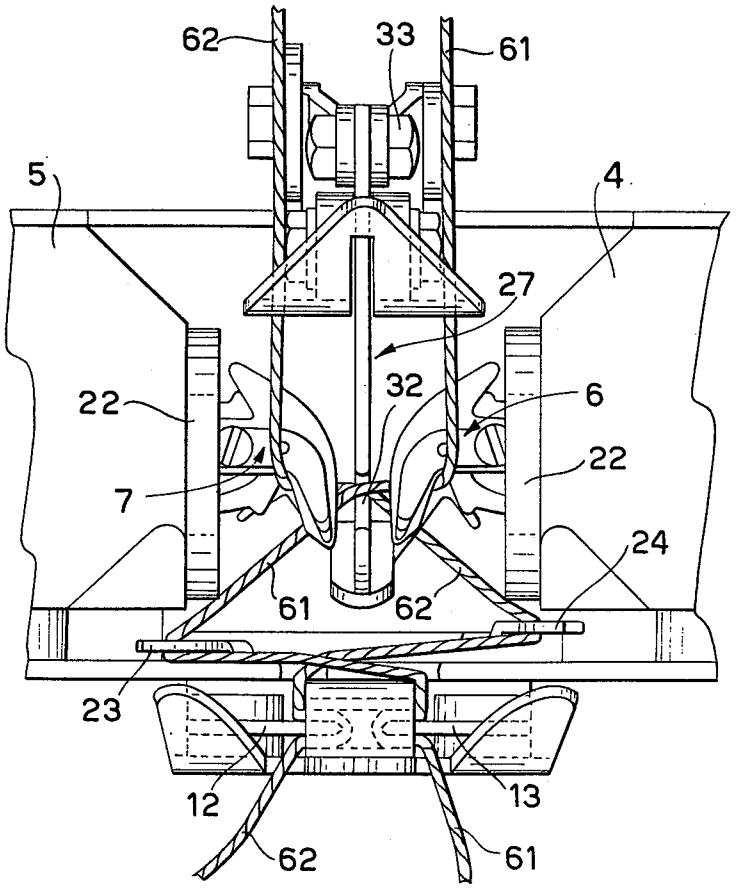

As the rotation of the control shaft 10 is started, the crossing members 23, 24 which are initially both on the rear side are firstly brought both on the front side so that the member 24 graps the thread 62 driving it towards the right (as viewed in FIG. 10), then the member 23 is restored to the rear side and drags with itself towards the right the yarn 61. Meanwhile, the members 12 and 13 have latched the yarns 61 and 62 between the pairs of springs 16 and 17 and the hooks 6, 7 have effected half a revolution and are brought to the position shown in FIG. 1. It is to be noted that in this operation the extractor 27 remains stationary in its at rest position as determined by the fixed abutment 45, but the throat 32 with its edge pointing towards the left side of the machine tends to keep the yarns 61, 62 crossed between the members 23, 24 and the shanks of the hooks 6, 7 near the hooks themselves to ensure that they can surely be grasped by the hooks during their further rotation, as can clearly be seen in FIG. 11.

Figure 12:
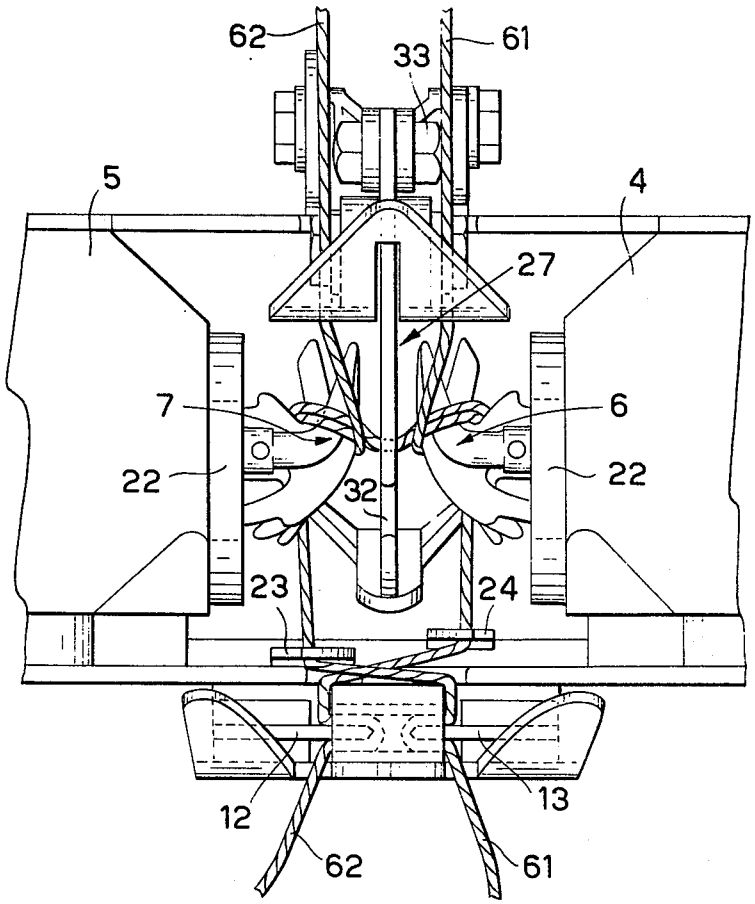

As the rotation of the shaft 10 is continued until completing its half revolution, the hooks 6, 7 complete their first complete revolution and are brought to the position of FIG. 12 with their scissors open and ready to receive the ends of the yarns 61, 62. In this stage the crossing members 23, 24 have been approached again and the portions of yarns between the two hooks 6, 7 have followed the shape of the throat 32 of the extractor 27 (still stationary in its at rest position) and have been brought on the edge of the throat pointing towards the right side of the machine.

Since, as can clearly be seen in FIG. 12, also the tails of the two yarns which are about to be severed by the scissors are conditioned as to their lengths by the shape of the throat 32, it is apparent that by varying such a shape it is possible to vary the lengths of the yarn tails.

From the foregoing illustration it is clear the function of the extractor member according to the invention, which is that of cooperating in the formation of the two individual knots of which the fisherman's knot is made.

By continuing the rotation of the shaft 10 and thus also that of the hooks 6, 7 the tails of the respective yarns 61, 62 are cut initially by the respective scissors. Then the crossing elements 23 and 24 are set apart again and simultaneously starts the first lifting stage of the extractor 27 controlled by the cam 42. The condition is now that of FIG. 6 in which starts the slipping stage or extraction of the individual knots formed about the hooks 6, 7 with the tails of the yarns still grasped by the hooks.

Figure 13:
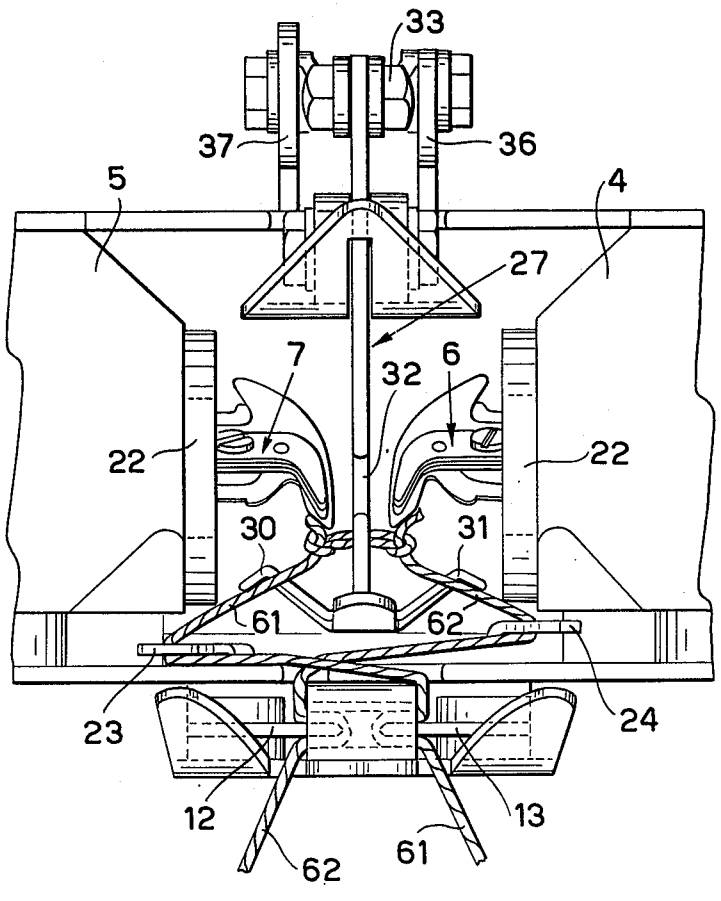

In this stage, by virtue of the movement of separation of the crossing members 23, 24 and the simultaneously lifting of the extractor 27, the portion of the yarns between the two hooks go in the reverse direction in the profile of the throat 32 and the two knots are then withdrawn or removed from the respective hooks 6, 7 under the most favourable conditions. It is to observe also in FIG. 13 that illustrates the operation, that the portions of the yarns which go from the two knots to the respective crossing members 23, 24 are grasped by the throats 30, 31 of the arm 29 of the extractor 27. Since, on the other hand, the tails of the individual knots are still held by the rotary hooks, there is a good tensioning of the said knots, once they have been slipped from the hooks. The first lifting stage of the extractor is thus completed as shown in FIG. 7.

Figure 8:
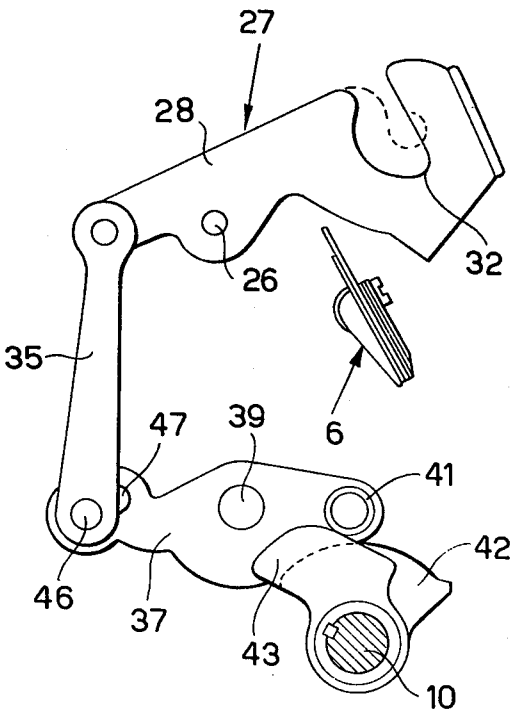
Figure 14:
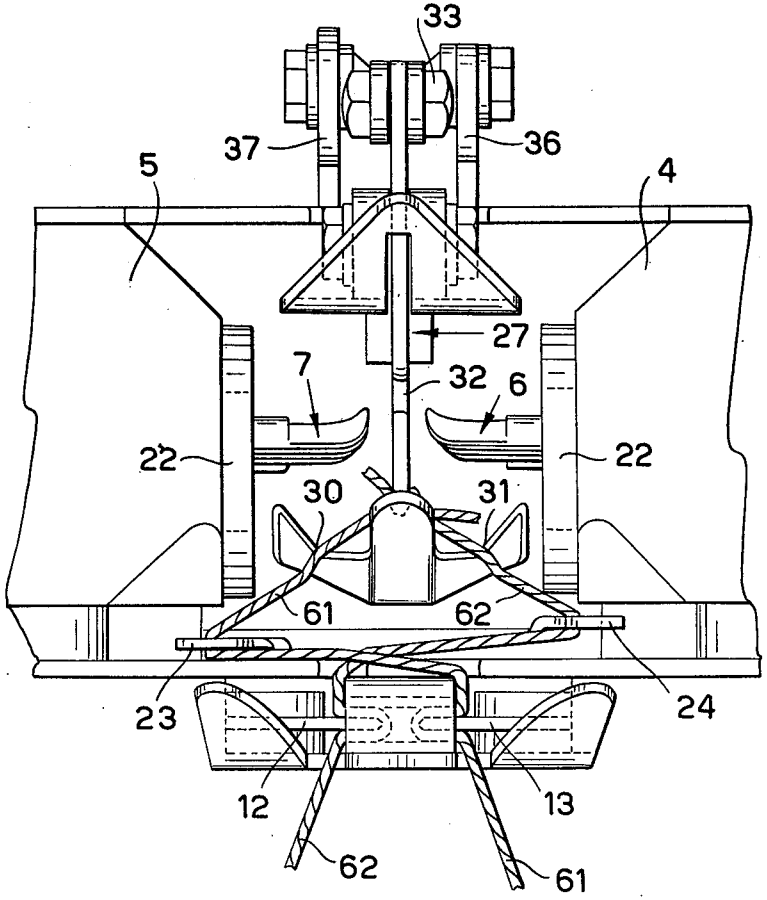

As the rotation of the shaft 10 proceeds and that of the hooks 6, 7 the tails of the two individual knots are released and thus starts the second lifting stage of the extractor 27 controlled by the second cam 43 (see FIG. 8). In this stage, the individual knots are no longer held by the hooks 6, 7 and are now approached to each other, since the two yarns 61, 62 are taut between the crossing members 23, 24 (in a position of mutual spacing-apart) the throats 30, 31 of the arm 29 of the extractor 27 and the throat 32 of the same member which holds the portions between the individual knots. In the position of maximum lift of the extractor 27 the two individual knots are latched together and the fisherman's knot is completed and receives the maximum tensioning (see FIG. 14 corresponding to the position of FIG. 9).

By virtue of the adjustability of the position of maximum lift of the extractor 27, the tensioning of the completed fisherman's knot can be adapted within certain limits to the characteristics of the yarns to be knotted.

Once the condition of maximum lift of the extractor 27 has been reached, the cycle of formation of the fisherman's knot has been concluded by a further rotation of the control shaft 10 to restore all the component parts of the machine to the starting position to leave the two knotted yarns free.

From the foregoing it is apparent that the extractor provided according to the present invention has a manifold function. As a matter of fact it cooperates actively during the first stage of the working cycle when it is still in the resting position for the formation of the two individual knots and determines with the profile of its throat 32 the length of the two free tails. Then, during the first stage of its lifting controlled by the cam 42 in fixed relationship with the rotation of the hooks 6, 7, it causes the slipping of the two knots from the respective hooks under the most favourable preselected conditions and provides to tension the two knots, and finally, during the second lifting stage controlled by the cam 43, it causes the union and the latching of the two knots with a tensioning which can be adjusted according to the characteristics of the yarns, due to the adjustability of its maximum lift.

These are the properties which have permitted to solve the problem of the automatic knotting of even coarse yarns.

Of course, the practical embodiment of the novelty ideas of the present invention can be made according to many changes which can easily be imagined by a skilled technician without departing from the scope of protection of this invention.

I claim:

1. An automatic knot-forming machine for the formation of the fisherman's knot, particularly for coarse-count yarns and intended to be mounted on an automatic spooler, comprising latching members for the yarns to be knotted, thread-crossing members, confrontingly mounted rotary hooks equipped with scissors for severing and holding the tails of the threads and an extractor and tensioning member for the knot, said members of latching, crossing and extractor member being controlled by cams mounted on a control shaft, characterized in that the extractor member is arranged oscillably between the rotary hooks on a plane midway vertical between an at rest lowered position and an adjustable raised position and is formed by a flat lever fulcrumed at an intermediate point and fitted in the vicinity of an end with a throat open upwards and with a transversal arm with two other throats open upwards in correspondence with the ends of said arm, at the opposite end of said lever being fulcrumed on a common pivot two control rods actuated through intermediate levers by two distinct cams mounted on the control shaft, the connection between one of these rods and the relative lever being fixed, while the connection between the other rod and the relative lever is adjustable, said cams being intended to control in two successive stages the lift of the extractor from the resting position to the raised position.

2. A machine according to claim 1, characterized in that one of said intermediate levers has at one end a slot in which there can be displaced and locked the pin of connection carried by the respective control rod of the extractor member.

3. A machine according to claim 1, characterized in that the open throat provided in the vicinity of the extractor has a variable shape and a variable depth.

4. A machine according to claim 1, characterized in that the resting position of the extractor is determined by the abutment of its edge against a fixed abutment.

* * * * *